US006257612B1

(12) United States Patent
Zanco et al.

(10) Patent No.: US 6,257,612 B1
(45) Date of Patent: Jul. 10, 2001

(54) GLIDING BOARD HAVING A RIGID RAISED PLATFORM

(75) Inventors: Alain Zanco, Voiron; Johan Vailli, La Murette; Denis Redor, Voiron, all of (FR)

(73) Assignee: Skis Rossignol S.A. (FR)

( * ) Notice: Subject to any disclaimer, the term of this patent is extended or adjusted under 35 U.S.C. 154(b) by 0 days.

(21) Appl. No.: 09/238,282

(22) Filed: Jan. 27, 1999

(30) Foreign Application Priority Data

Jan. 29, 1998 (FR) ..... 98 01248

(51) Int. Cl.[7] ..... A63C 5/00
(52) U.S. Cl. ..... 280/607; 280/617
(58) Field of Search ..... 280/607, 610, 280/617, 618, 602, 609, 636

(56) References Cited

U.S. PATENT DOCUMENTS 3,797,844 * 3/1974 Smolka et al. ..... 280/617
3,802,714 * 4/1974 Freegard ..... 280/607
3,852,896 * 12/1974 Pyzel et al. ..... 280/617
5,397,150 * 3/1995 Commier et al. ..... 280/617 X
5,474,321 12/1995 Pritz ..... 280/607
5,671,939 * 9/1997 Pineau ..... 280/607 X
5,779,258 * 7/1998 Luitz et al. ..... 280/607 X
5,871,223 * 2/1999 Zanco ..... 280/607
5,944,336 * 8/1999 Fagot ..... 280/607

FOREIGN PATENT DOCUMENTS 43 17 675 A1 5/1993 (DE) .
195 42 055 A1 11/1995 (DE) .
0 744 196 A1 5/1996 (EP) .

* cited by examiner

*Primary Examiner*—Michael Mar
(74) *Attorney, Agent, or Firm*—Wall Marjama & Bilinski

(57) ABSTRACT

A gliding board has a raised platform which is intended to accommodate the toe piece and the heel piece of a safety binding on its upper part and which rests on the board via its central part. The platform has its front and rear ends overhanging relative to the upper surface of the board and not resting on the board. The platform has a torsional stiffness such that the maximum angular deformation of a free end under the effect of a twisting moment of four newton-meters exerted at four hundred and sixty millimeters from an engagement zone is less than one and a half degrees.

14 Claims, 6 Drawing Sheets

GLIDING BOARD HAVING A RIGID RAISED PLATFORM

FIELD OF THE INVENTION

The invention relates to a gliding board, in particular for gliding on snow, for the practice of skiing or the like. It may be an alpine ski or a cross-country ski.

BACKGROUND OF THE INVENTION

Gliding boards having a raised platform which is intended to accommodate the toe piece and the heel piece of the safety binding on its upper part are already known. This platform rests on the gliding board over its entire length in the support region (see for example documents FR 2 649 902 corresponding to U.S. Pat. No. 5,135,250 and FR 2 675 390 corresponding to U.S. Pat. No. 5,393,086).

The Applicant's document FR 2 734 489 described a monolithic raised platform whose front and rear ends overhang and do not rest on the board.

These skis with a raised platform whose ends overhang have, on the one hand, the advantage of raising the skier's feet relative to the ski board and thereby increase the angle at which the edge can be set before the foot slips and, on the other hand, make it possible to unclamp the ski, which keeps the intrinsic mechanical properties of the board, without affecting the rigidity of the boot. Further, the thrusting force of the heel piece has no effect on the curvature of the ski. This provides a uniform assembly which does not substantially rigidify the ski flexurally.

SUMMARY OF THE INVENTION

The object of the invention is to improve this type of gliding board with a raised platform whose ends overhang.

According to the invention, the gliding board, of the type having a raised platform which is intended to accommodate the toe piece and the heel piece of a safety binding on its upper part and which rests on the board via its central part, said platform having its front and rear ends overhanging and not resting on the board, is one wherein said platform has a torsional stiffness such that the maximum angular deformation of a free end under the effect of a twisting moment of four newton meters (4 N.m) exerted at four hundred and sixty millimeters (460 mm) from an engagement zone is less than one and a half degrees (1.5°).

This torsional stiffness feature is useful for allowing better accuracy when executing turns, which is necessary for the practice of slalom.

Advantageously, in practice, the platform has a tubular structure over the essential part of its length and at least over part of its cross section.

The use of a tubular structure over the essential part of its length and at least over part of its cross section makes it possible to optimize the weight/stiffness ratio, that is to say to obtain a hollow structure which is torsionally stiff for minimal weight. For example, for a cylindrical hollow tube having an internal diameter equal to one half of the external diameter, compared with a solid tube having the same diameter, the angle of twist and the maximum strain are increased by approximately six per cent (6%), while the reduction in weight is as much as twenty-five per cent (25%).

The combination of these two characteristics makes it possible to obtain a ski having a high degree of accuracy, while having minimal weight, which is therefore well-suited to competition.

Advantageously, in practice:

- the platform has a linear density of less than 800 grams per meter of length, preferably close to 700 grams per meter of length; this is because it has been observed that, if the weight exceeds 800 grams, this impairs the quality of skiing;
- the platform has a plurality of tubular structures parallel to its longitudinal axis;
- the platform centrally has an inverted-U profile; the parallel branches of the U then have a tubular structure and bear on the gliding board; in a variant, at least the portion connecting the branches of the inverted-U includes tubular structures over its entire length;
- the platform is made of light metal, for example aluminum or other metal alloys, or of composite structure: textile/plastic;
- the platform is made of a composite and the longitudinal hollow structure is filled with an expanded foam;
- the ratio between the length of contact (A) of the platform with the board (or lower part) and the length (L) of said platform (or upper part) satisfies the formula:

$$0.25<A/L<0.75$$

with L between 450 and 600 mm, in order to accommodate standard lengths of safety bindings and boot sizes.

It has been observed that, if this ratio A/L is less than 0.25, the platform then overhangs too much, which compromises the torsional and flexural stiffnesses of the assembly; however, if this ratio exceeds 0.75, the assembly is flexurally too rigid.

Likewise, the height H by which the platform is raised relative to the top of the ski should advantageously be between 10 and 60 mm.

DESCRIPTION OF THE PREFERRED EMBODIMENTS

Figure 1:
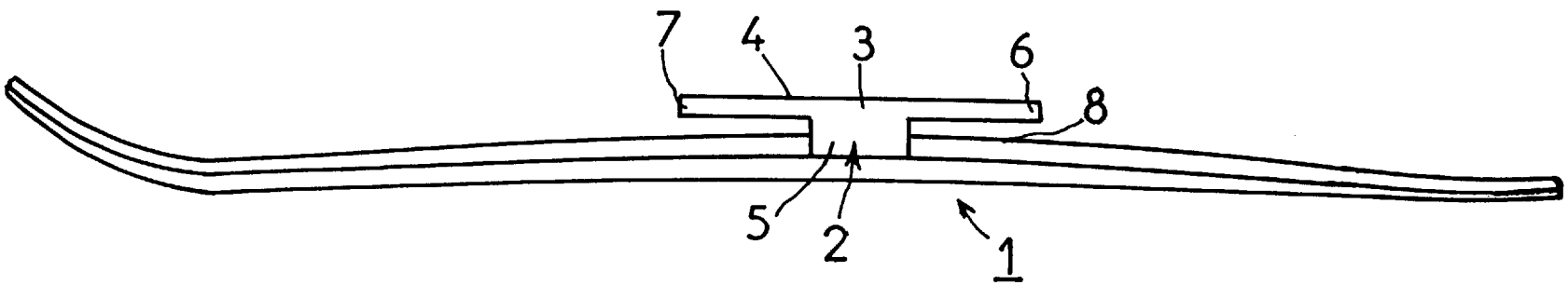
FIG. 1 represents a section of a ski with its raised platform.

In its support region (2), the ski according to the invention (1) (see FIG. 1) accommodates a raised platform (3) intended to accommodate the conventional toe piece and heel piece (not shown) of the safety binding on its upper part (4).

This platform (3) rests on the support region by its central part (5). The rear (6) and front (7) ends of the platform (3) overhang and do not rest on the upper part (8) of the ski.

In its central region (5), the platform has an inverted-U cross section (see FIGS. 2 to 5).

According to an advantageous feature of the invention, this platform has a tubular structure over its entire length and at least over part of its cross section.

Figure 2:
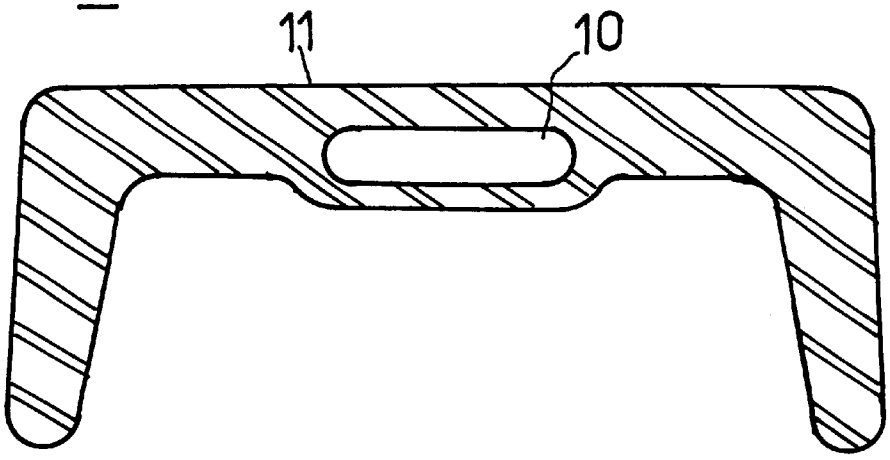
FIGS. 2 and 3 are a schematic representation of a cross section of the central part of a platform according to the invention.

In a first embodiment, shown in FIG. 2, this structure includes a longitudinal hollow part (10) which is arranged at the center of the plane connection portion (11) intended to accommodate the binding.

Figure 3:
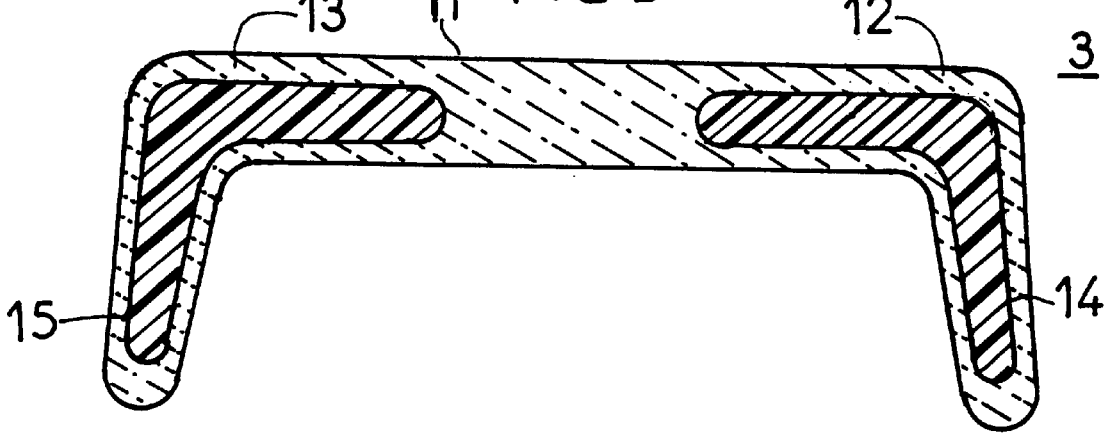

In another embodiment, shown in FIG. 3, the characteristic tubular structures (12, 13) are arranged essentially in the branches (14, 15) of the U-shaped platform.

In the embodiment shown in FIG. 3, the walls (12, 13) of the longitudinal tubular structure of the platform are made of a composite, and the hollow parts are filled with foam in order to make the assembly lighter.

Figure 5:
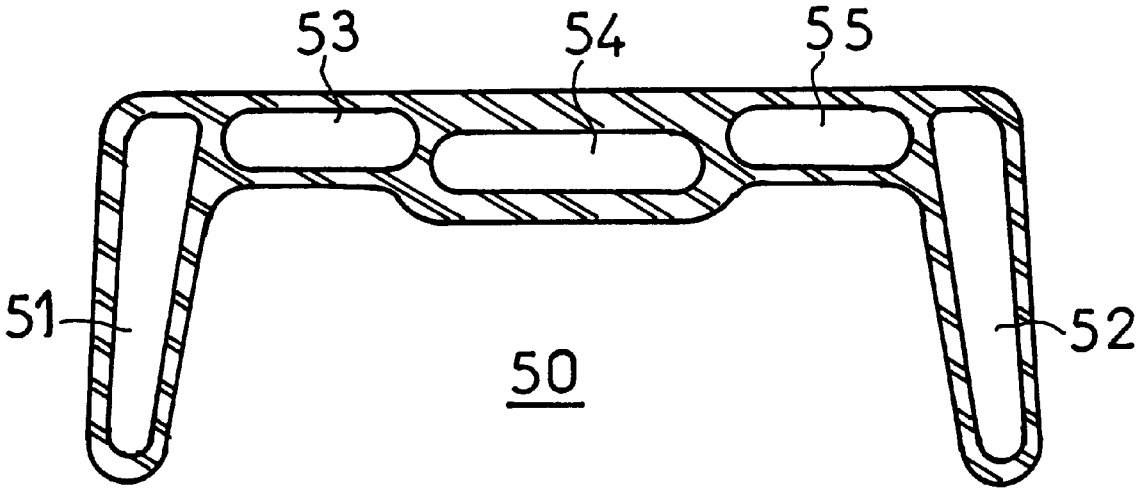
FIG. 5 is a cross-sectional representation of a preferred version of the profiles of the platform according to the invention.

By contrast, in the embodiment shown in FIG. 2 or in FIG. 5, the platform is made of a light metal, in particular of aluminum alloy.

In a variant which has not been represented, the platform may have a rectangular cross section so long as it does indeed correspond to the features of the invention, that is to say with walls of tubular longitudinal section and the torsional stiffness feature.

Figure 4:
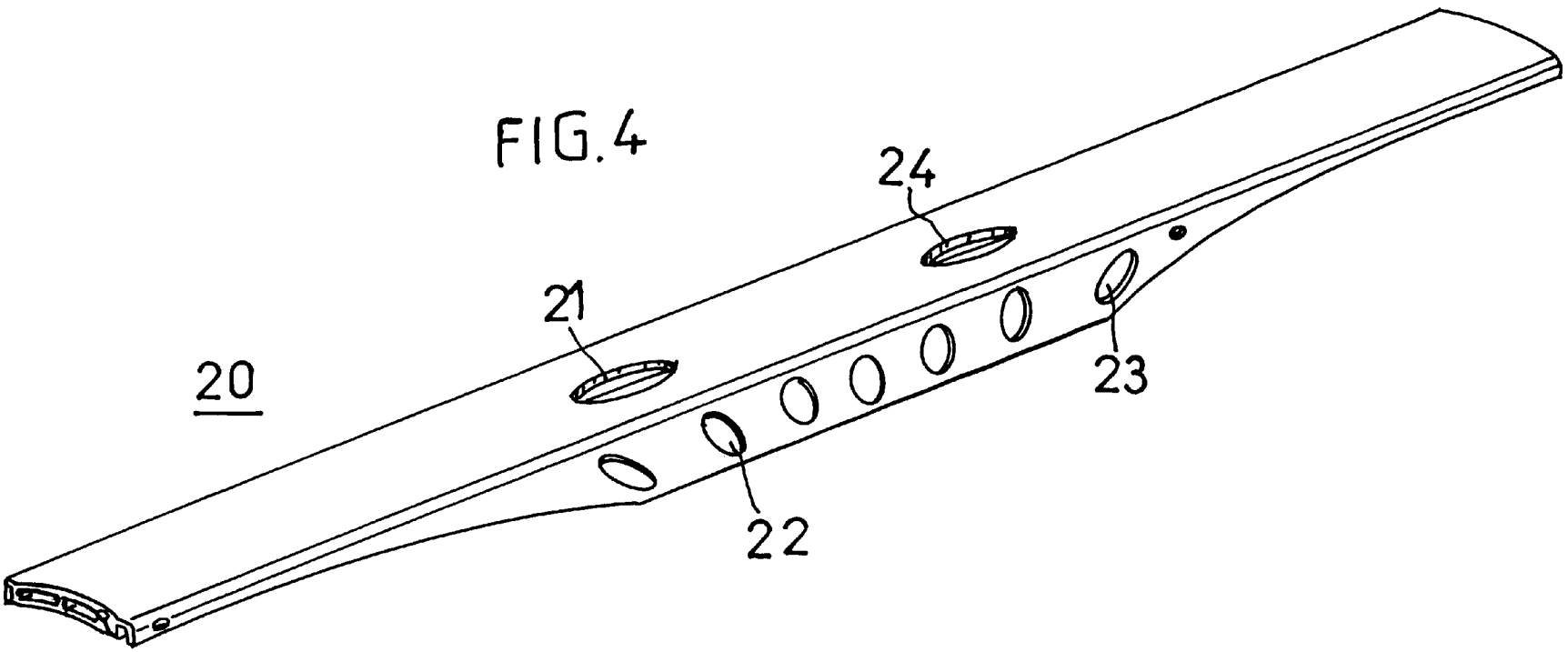
FIG. 4 is an outline perspective view of a platform characteristic of the invention.

The platform (20) shown in FIG. 4 is made lighter by orifices (21, 22, 23, 24) which furthermore make it possible to accommodate the elements by which the platform is fastened on the ski.

Figure 6:
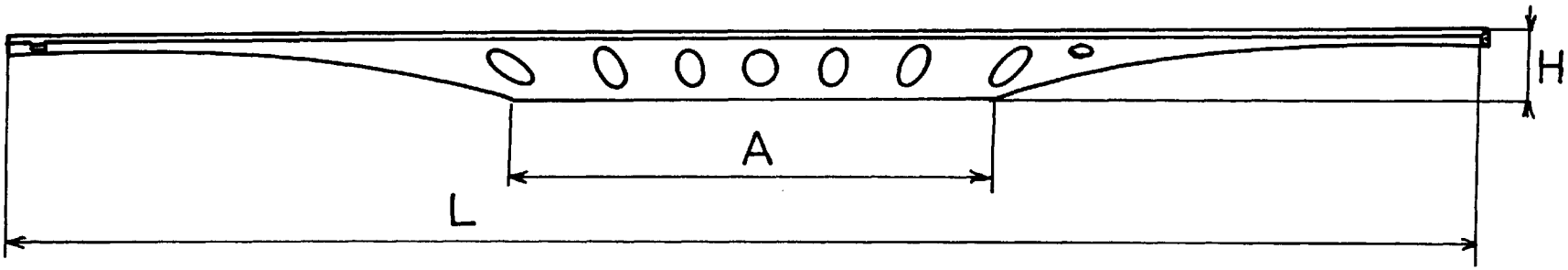
FIGS. 6 and 7 are a representation of a preferred platform according to the invention, respectively seen from the side (FIG. 6) and seen from above (FIG. 7).
Figure 7:
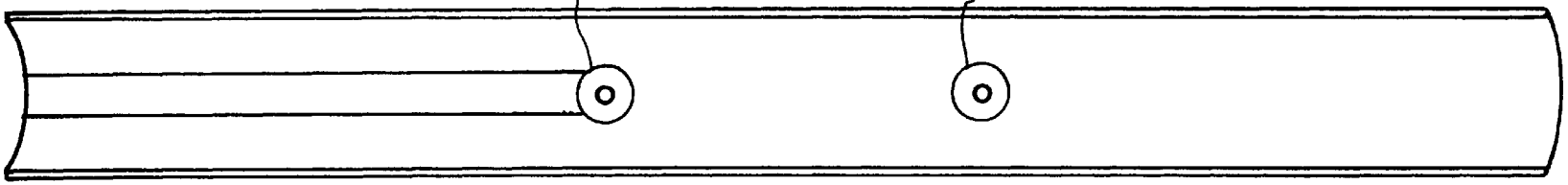

According to another characteristic of the invention, the ratio between the line of contact A of the inverted-U platform (30) (see FIG. 6) with the ski and the length L of said platform satisfies the formula:

$$0.25<A/L<0.75$$

with L between 450 and 600 mm, in order to correspond to the various sizes of ski boots and the various safety binding lengths.

Advantageously (see FIG. 6), the raised height H relative to the upper face of the ski and, more generally, relative to the contact region on the ski, is between 10 and 60 mm.

In the preferred embodiment shown in FIG. 5, the platform (50) in the form of an inverted U has a plurality of parallel tubular longitudinal cavities, respectively arranged (51) and (52) in the two parallel branches of the U which bear on the ski, and (53, 54, 55) in the plane upper connecting branch on which the safety binding bears.

This platform (50) is advantageously made in an extruded profile of light metal, in particular of aluminum alloy, so that the weight is close to 700 grams per meter of length.

In a variant which has not been illustrated, the characteristic tubular longitudinal cavity may adopt the full shape of the inverted U.

According to another essential feature of the invention, the characteristic tubular platform should have a torsional stiffness such that the maximum deformation of a free end under the effect of a twisting moment of 4 N.m is less than one and a half degrees (1.5°).

If this torsional stiffness exceeds one and a half degrees (1.5°), the ski will suffer substantial losses of accuracy in initiating and executing turns, which is a critical problem for competition slalom .

Figure 8:
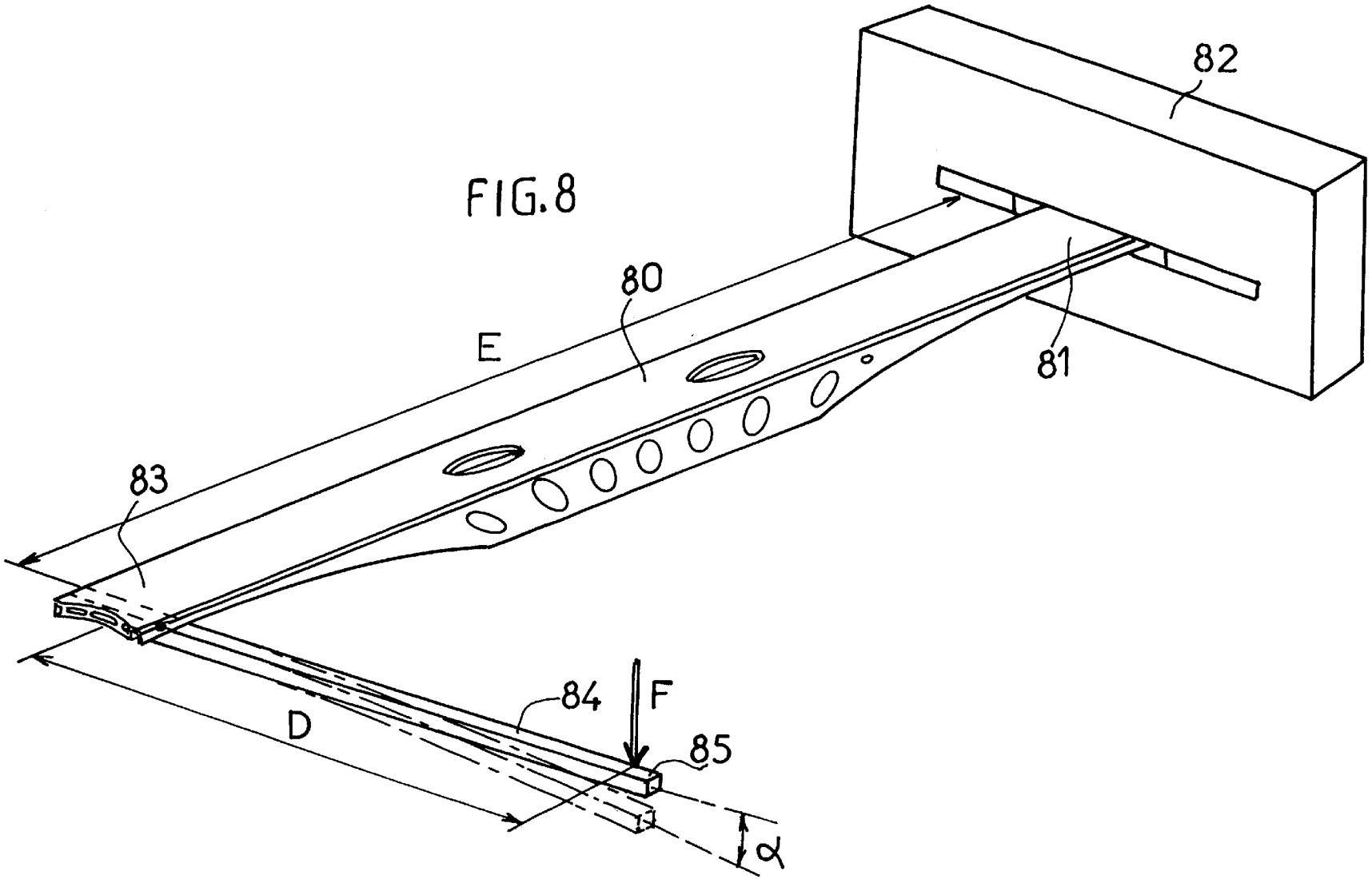
FIG. 8 illustrates the conditions under which the torsional stiffness characteristic of the invention is measured.

This torsional stiffness feature is measured under the following conditions illustrated in FIG. 8.

The characteristic platform (80) is locked by its front or rear end (81) in a vice or the like (82). A lever arm (84) which is orthogonal to the platform is applied to the opposite free end (83), and a force F is exerted on the end (85) of this lever arm. If the distance of the lever (84) is one meter (1 m), and the force is equivalent to the weight of a 0.4 kg mass, a twisting moment of four newton meters is thus obtained. Under these conditions, the deformation a of the end (83) should be at most one and a half degrees (1.5°), this being for a distance E of 460 mm between the engagement and the application of the moment.

The invention is particularly useful for competition slalom skis.

What is claimed is:

1. A raised platform, said platform including a gliding board for skiing, comprising:

an upper part having a front end and a rear end for accommodating a toe piece and a heel piece of a safety binding, said front and rear ends overhanging and not in contact with an upper surface of said gliding board; and a support region having a central region affixed to said gliding board;

wherein said platform has a torsional stiffness such that the maximum angular deformation of a free end when subject to a twisting moment of four newton-meters exerted 460 millimeters from an engagement zone is less than one and one-half degrees;

wherein said raised platform has a an internal tubular structure over its entire length, and at least over part of its cross-section to achieve said torsional stiffness;

wherein said tubular structure is formed by a plurality of enclosed tubular cavities axially aligned with a longitudinal axis of said gliding board; and wherein said platform centrally has an inverted U-shaped profile whose parallel branches have a tubular structure and bear on the gliding board.

2. The raised platform, as recited in claim 1, wherein said platform has a linear density of less than 800 grams per meter length.

3. The raised platform, as recited in claim 2, wherein said platform has a linear density of approximately 700 grams per meter length.

4. The raised platform, as recited in claim 1, wherein the ratio between a line of contact of said platform and a length of said platform is greater than 0.25 and less than 0.75 and wherein said length is between 450 millimeters and 600 millimeters.

5. The raised platform, as recited in claim 4, wherein a height from the top of the ski to the platform is between 10 and 60 millimeters.

6. A raised platform which rests on a gliding board for skiing, comprising:

an upper part of said platform having a front end and a rear end for accommodating a toe piece and a heel piece of a safety binding, said front and rear ends overhanging and not in contact with an upper surface of said gliding board;

a support region having a central region affixed to said gliding board;

an internal tubular structure over an entire length of said platform;

said tubular structure being formed by a plurality of enclosed tubular cavities axially aligned with a longitudinal axis of said gliding board, wherein at least part of one tubular cavity is in said upper part of said platform;

wherein said platform has an inverted-U shaped cross-section whose parallel branches each have a tubular structure and bear on the gliding board throughout a length of each parallel branch.

7. The raised platform which rests on a gliding board for skiing, as recited in claim 6, wherein said platform has a torsional stiffiess such that the maximum angular deformation of a free end when subject to a twisting moment of four newton-meters exerted 0.46 meters from an engagement zone is less than one and one-half degrees.

8. The raised platform as recited in claim 6, wherein the tubular structure in each parallel branch of the inverted-U shaped cross-section of the platform includes a single tubular cavity axially aligned with a longitudinal axis of said gliding board.

9. The raised platform as recited in claim 6, wherein the tubular structure in said upper part of said platform includes at least two tubular cavities axially aligned with a longitudinal axis of said gliding board.

10. The raised platform as recited in claim 6, wherein the tubular structure in said upper part of said platform includes at least three tubular cavities axially aligned with a longitudinal axis of said gliding board.

11. The raised platform as recited in claim 6, wherein:

the tubular structure in each parallel branch of the inverted-U shaped cross-section of the platform includes a single tubular cavity axially aligned with a longitudinal axis of said gliding board; and the tubular structure in said upper part of said platform includes at least three tubular cavities axially aligned with a longitudinal axis of said gliding board.

12. The raised platform, as recited in claim 1, wherein said raised platform is made of a light metal.

13. The raised platform, as recited in claim 1, wherein said raised platform is made of a plastic/textile composite.

14. The raised platform, as recited in claim 1, wherein at least one of said enclosed tubular cavities is filled with expanded foam.

* * * * *